United States Patent [19]

Rife, Jr. et al.

[11] Patent Number: 4,938,537

[45] Date of Patent: Jul. 3, 1990

[54] END CLOSURE FOR A ROTARY CUTTER HOUSING

[75] Inventors: Conwell K. Rife, Jr., Champlin; William A. Schmieg, Nevis, both of Minn.

[73] Assignee: Caterpillar Paving Products Inc., Minneapolis, Minn.

[21] Appl. No.: 425,524

[22] Filed: Oct. 23, 1989

[51] Int. Cl.[5] ..... E01C 23/09

[52] U.S. Cl. ..... 299/39; 37/108 A; 172/112; 404/90

[58] Field of Search .....299/39; 404/90, 91, 404/92; 37/108 A; 172/112, 123

[56] References Cited

U.S. PATENT DOCUMENTS

| | | | |
|---|---|---|---|
| 3,746,101 | 7/1973 | Takata | 172/112 |
| 3,901,325 | 8/1975 | Richards | 172/112 X |
| 4,325,580 | 4/1982 | Swisher, Jr. et al. | 299/39 |

FOREIGN PATENT DOCUMENTS

| | | | |
|---|---|---|---|
| 2150620 | 7/1985 | United Kingdom | 299/39 |
| 2152118 | 7/1985 | United Kingdom | 404/90 |

*Primary Examiner*—Jerome W. Massie, IV
*Assistant Examiner*—David J. Bagnell
*Attorney, Agent, or Firm*—Robert A. McFall

[57] ABSTRACT

An end closure for the cutter housing of a road planer in which a pair of self-opening and self-closing cover plates provide a protective cover over a shaft clearance opening in the end wall of the housing. The cover plates, pivotally mounted on an external wall surface of the housing, move between a closed position at which the cover plates cooperatively overlay the shaft clearance opening, and an open position at which clearance is provided for a rotatable shaft extending through the housing end wall, in response to moving the end wall vertically with respect to the frame on which the cutter is rotatably mounted.

2 Claims, 2 Drawing Sheets

END CLOSURE FOR A ROTARY CUTTER HOUSING

DESCRIPTION

1. Technical Field

This invention relates generally to an end closure for a rotary cutter housing on a road planer, and more particularly to a self-actuating end closure for a rotary cutter housing.

2. Background Art

Road planers, also known as pavement profilers, road milling machines or cold planers, are machines designed for scarifying, removing, mixing or reclaiming material from roadway and similar surfaces. These machines typically have a rotatable cutter that is vertically adjustable with respect to the working surface. The rotatable cutter is enclosed within a housing that prevents the uncontrolled discharge of the cut roadway material. In operation, the lower portion of the housing abuts the uncut roadway surface adjacent the working area at the same time the cutter is removing material to a predetermined depth below the surface of the working area. Therefore, the housing must be vertically adjustable with respect to the rotatable cutter. Furthermore, since the cutter is mounted on an externally driven rotatable shaft that necessarily extends beyond at least one end of the housing, clearance for the shaft must be provided in the housing end wall to permit movement of the cutter into a working area elevationally lower than the surrounding roadway surface.

Several arrangements have been proposed for covering the shaft clearance opening in the housing end wall so that debris and other material are not discharged through the opening during operation of the road planer. U.S. Pat. No. 3,746,101 issued July 17, 1973 to Harry H. Takata, discloses an earthworking vehicle having a rotatable cutter enclosed within a housing. The housing has an internally mounted rotatable plate that pivots in compliance with the relative vertical displacement of the cutter to maintain a cover over the shaft clearance opening. However, it has been found that debris generated during operation of such machines is easily lodged between the pivot plate and the housing or plate guides thereby impeding operation of the housing and cutter. Also, cut material retained within the housing may build up between the rotatable plate and the end wall of the housing, resulting in damage to the cover plate.

Other arrangements include the use of a plurality of removable plates having a predetermined width and temporarily secured, such as by machine screws, over the shaft clearance opening. The plates are removed, or reinstalled as required, to maintain as small an opening as possible while at the same time permitting the cutter to operate at the desired depth. As can be readily seen, this arrangement requires constant attention and adjustment, i.e., removal or reinstallation of plates, to be effective.

Still other arrangements include the use of flexible mats and skirts which deflect as the position of the housing is adjusted with respect to the cutter. Such members, typically constructed of heavy canvas or rubberized materials, are only partially effective in retaining the cut material within the housing enclosure and are prone to wear, thus requiring frequent replacement.

The present invention is directed to overcoming the problems set forth above. It is desirable to have a housing for a road planer in which the clearance opening for the rotatable shaft assembly extending through an end wall of the housing has a self-closing cover arrangement that is positioned away from the internal debris-filled environment of the housing. It is also desirable to have such a cover arrangement that is self-opening to provide the necessary clearance for the rotatable shaft assembly as the cutter is lowered into a working area, and simultaneously effectively closes the exposed portion of the shaft clearance opening.

DISCLOSURE OF THE INVENTION

In accordance with one aspect of the present invention, an end closure of a housing on a road planer, in which the housing encloses a rotary cutter having a centrally disposed rotatable shaft assembly mounted on a frame, has a vertically movable end plate forming an end of the housing. The end plate has an opening for the rotatable shaft assembly that extends in a substantially vertical direction. A pair of cover plates are pivotally mounted on the end plate. In response to moving the end plate in a vertical direction with respect to the frame, the cover plates move between a closed position, at which they cooperatively overlay the end plate opening, and an open position at which the cover plates are spaced from the opening.

Other features of the end closure include a groove in each of the cover plates and a pair of pins attached to the frame. The pins extend outwardly from the frame and engage a groove, respectively, in one of the cover plates.

BEST MODE FOR CARRYING OUT THE INVENTION

Figure 1:
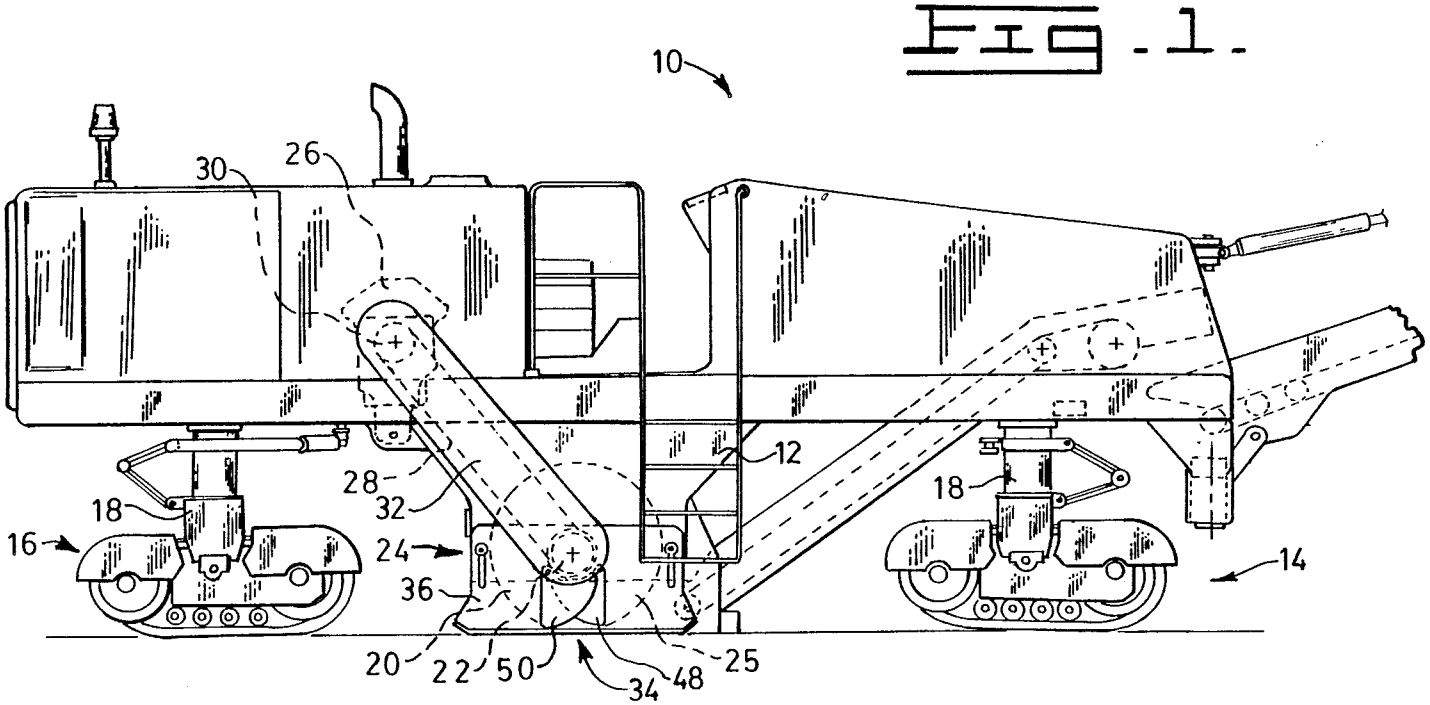
FIG. 1 is a side view of a road planer having a rotary cutter enclosed within a housing embodying the present invention.

A road planer, generally indicated by the reference numeral 10, comprises a frame 12 that is carried for movement along a road surface by a pair of front track assemblies 14 and a pair of rear track assemblies 16. The frame is supported on the track assemblies 14,16 by adjustable struts 18 which extend respectively between each of the track assemblies and the frame. A rotary cutter 20 has a centrally disposed shaft assembly 22 that is rotatably mounted on the frame 12. A vertically adjustable housing 24 surrounds all but the bottom of the cutter 20 which is necessarily exposed to the road surface. The path 25 circumscribed by the cutting teeth of the rotary cutter is shown by dashed lines in FIGS. 2 and 3.

The rotary cutter 20 is driven by an engine 26 that is mechanically connected to the rotatable shaft assembly 22 of the cutter by an endless belt 28 extending between a drive pulley 30, engagably connected to the engine 26, and the shaft assembly. A guard housing 32 encloses the endless belt 28, the drive pulley 30 and the driven end of the shaft assembly 22.

With the rotary cutter 20 mounted directly to the frame 12, the vertical relationship of the rotary cutter 20 with respect to the road surface, i.e., the depth of cut or penetration of the cutting teeth carried on the cutter 20 into the ground, is controlled by appropriate extension or retraction of one or more of the adjustable struts 18. In order to maintain contact with the surrounding ground or road surface at varying depths of cut, the cutter housing 24 must therefore be vertically movable independently of the frame 12 and the cutter 20.

Figure 2:
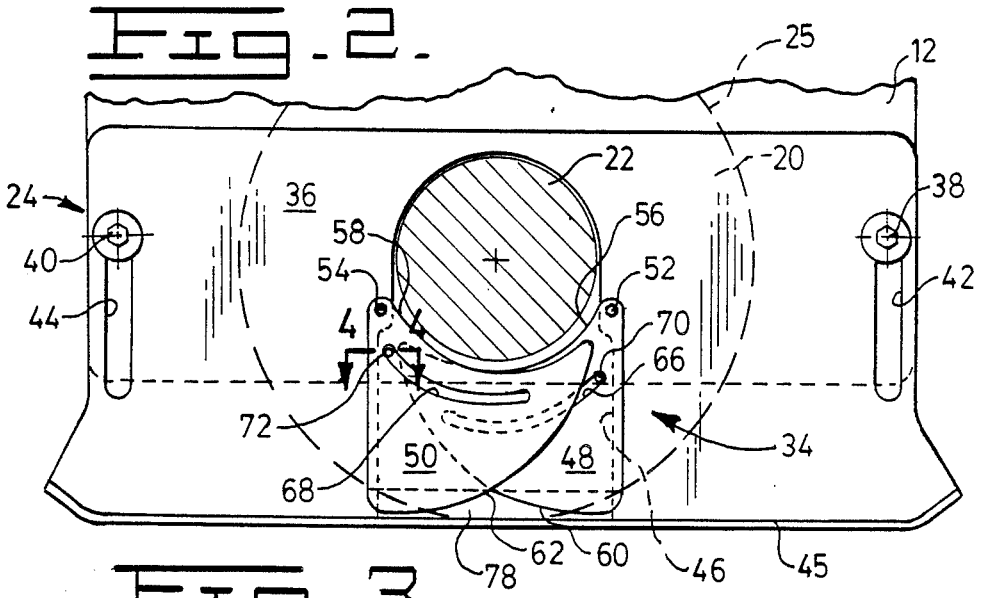
FIG. 2 is a plan view of the end closure for the housing embodying the present invention, showing the cover plates of the end closure in a closed position.
Figure 3:
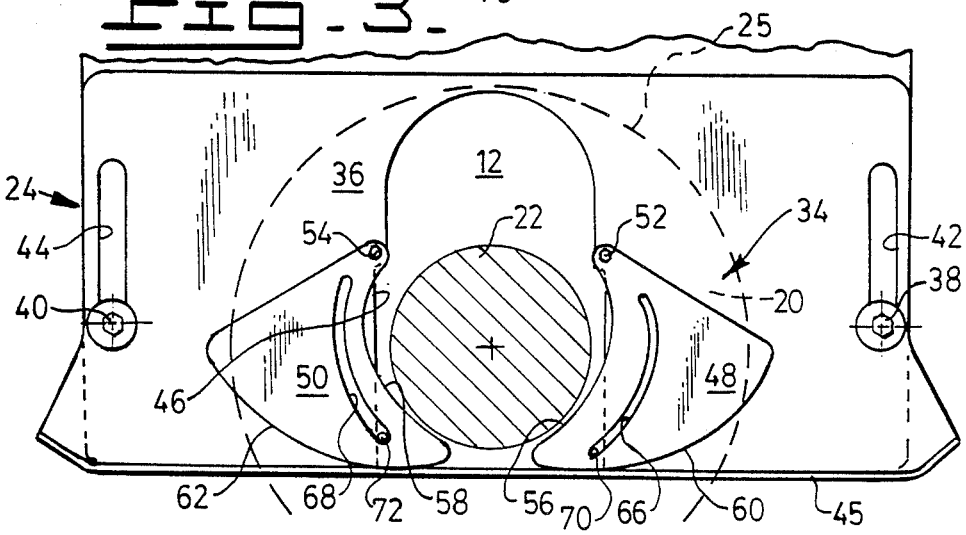
FIG. 3 is a plan view of the end closure of the housing embodying the present invention, showing the cover plates of the end closure in an open position.
Figure 4:
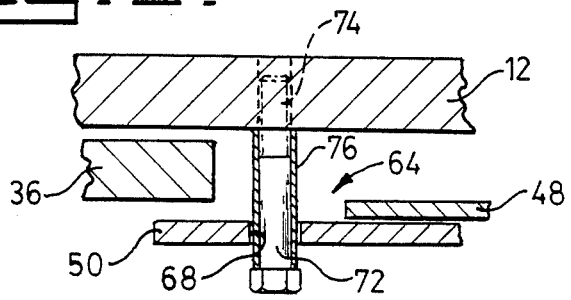
FIG. 4 is a sectional view of the end closure taken along the line 4—4 of FIG. 2.

In the preferred embodiment of the present invention, shown in greater detail in FIGS. 2, 3 and 4, the rotary cutter housing 24 has an end closure assembly 34 forming an end of the housing. The end closure assembly 34 comprises a vertically movable end plate 36 slidably mounted on the frame 12 transversely with respect the rotatable shaft assembly 22 which projects through the end plate 36. A pair of pins 38,40 extend outwardly, i.e., away from the interior of the housing, and respectively engage one of a pair of vertically oriented slots 42,44 provided in the end plate 36. Each of the pins 38,40 have a washer, having a diameter larger than the width of the slot, disposed between the head of the pin and the end plate 36 to maintain the end plate in a position abutting the frame 12. The slots permit the end plate 36 to move vertically with respect to the frame 12. A wear strip 45 extends along the lower, surface contacting edge of the end plate.

The end plate 36 also has a centrally disposed opening 46 extending in a substantially vertically direction and having a width sufficient to provide clearance for the rotatable shaft assembly 22 as the end plate 36 is moved vertically with respect to the shaft assembly 22.

The end closure assembly 34 also includes a pair of cover plates 48,50 pivotally attached to the end plate 36, respectively, by a pair of sleeved pivot pins 52,54 that extend through the respective cover plate and threadably engage the end plate 36. The cover plates 48,50 are generally triangularly shaped in which two of the three outer edges are arcuately shaped. A respective upper edge 56,58 of each of the cover plates 48,50 has a radius of curvature slightly greater than the radius of the rotatable shaft 22 so that when the plates are in the closed position, shown in FIG. 2, the cover plates cooperate with the end plate 36 to provide a generally circular opening for the shaft assembly 22. The respective radial edges 60,62 of the cover plates 48,50, i.e., the edges opposite the respective pivot pins 52,54 have a circular curvature, the radial center of which coincides with the center of the respective pivot pin and the radial length coincides with the distance between the respective pivot pin and the lower edge of the end plate 36.

The end closure assembly 34 further includes a means 64 for moving the cover plates 48,50 between a closed position at which the cover plates cooperatively overlay the centrally disposed shaft clearance opening 46 and an open position at which the cover plates 48,50 are spaced from the opening 46. The means 64 for moving the cover plates 48,50 comprises a pair of arcuate grooves 66,68 each extending respectively through a corresponding one of the cover plates 48,50, and a pair of follower pins 70,72 attached to the frame 12 and extending outwardly from the frame. As shown in FIG. 4, each of the follower pins 70,72 have a threaded end 74 that is threaded into the frame 12, and a sleeve 76 extending between the head of the pin and the frame 12.

The frame-mounted follower pins 70,72 respectively engage a corresponding one of the arcuate grooves 66,68 in the cover plates 48,50 and co-act with the corresponding groove to move the cover plates into the overlapping relationship shown in FIG. 2, or alternatively into the spaced apart relationship shown in FIG. 3, or into an intermediate position between the overlapping and spaced apart positions. The position of the cover plates 48,50 with respect to each other and with respect to the centrally disposed shaft clearance opening 46 is determined by the position of the frame 12 with respect to the end plate 36 of the housing 24. The cover plates 48,50 are moved toward the closed, or overlapping, position shown in FIG. 2 as the frame 12 is raised with respect to the end plate 36. Conversely, as the frame 12 is lowered with respect to the end plate 36, the cover plates 48,50 are moved toward the open, or spaced apart, position shown in FIG. 3.

In the closed position, the cover plates 48,50 cooperatively overlay the otherwise exposed portion of the shaft clearance opening 46 thereby effectively providing a barrier across the opening to prevent discharge of material removed from the roadway by the cutter 20 to the external environment. As the frame 12, and consequently the rotary cutter 20 attached thereto, is lowered to increase the depth of cut into the roadway surface, the sleeved follower pins 70,72 bear against their respective grooves 66,68 to progressively urge the cover plates 48,50 away from one another, thereby providing progressive clearance for the shaft assembly 22. If the cutter 20 is raised to decrease the depth of cut, the frame mounted follower pins 70,72 will urge the plates toward the overlapping position thereby progressively closing the exposed portion of the central opening 46.

As a result of the circular curvature of the radial edges 60,62 on the cover plates 48,50, a small area at the center of the opening 46 adjacent the lower edge of the end plate 36, is not covered. To provide for coverage of this area, a narrow plate 78 is removably attached, such as by screws, to the end plate. The width of the plate 78 required to close the opening below the cover plates 48,50 is determined by the size of the shaft clearance opening 46. For example, if the shaft clearance opening 46 extends 33 cm (13.0 in) below the shaft assembly 22 when the frame is in its uppermost position with respect to the end plate 36, i.e., the cutter has 33 cm of vertical travel with respect to the housing 24, and the width of the shaft clearance opening 46 is 45.7 cm (18.0 in) wide, the removable plate 78 should be about 7.6 cm (3 in) wide to provide complete closure of the opening 46. Thus, the shaft assembly 22 can move 25.4 cm (10.0 in) below its position flush with the roadway surface before encountering interference with the removable plate 78. The removable plate 78 would therefore not require removal unless the depth of cut exceeds 25.4 cm (10.0 in). For all cutting operations wherein the rotary cutter 20 is lowered less than 25.4 cm (10 in) with respect to the housing 24, the removable plate 76 should remain in place as shown in FIG. 2.

INDUSTRIAL APPLICABILITY

The end closure assembly 34 of the present invention is particularly useful for application on the rotary cutter housing of a road planer. In operation, the housing 24 is independently movable with respect to the rotary cutter 20 that is mounted on a rotatable shaft 22 within the housing. The housing 24 rides on a roadway surface whereas the cutter 24 operates at preselected distances below the roadway surface. The rotatable shaft 22 necessarily extends through at least one end of the housing, and therefore an opening to permit the relative vertical movement of the shaft is provided in the housing end wall.

In the present invention, a pair of cover plates 48,50 automatically open or close, as required, to effectively provide a protective cover over the shaft clearance opening 46 in the end wall 36 of the housing 24 irrespective of the relative vertical relationship of the rotary cutter 20 and the housing. The cover plates 48,50, mounted externally on the housing 24, are self-opening and self-closing in response to vertical movement of the end wall 36 with respect to the frame 12 on which the cutter 20 is rotatably mounted. As the cutter is lowered into a cutting area extending below the surrounding roadway surface, the cover plates 48,50 move apart from an overlapping position to provide clearance for the rotatable shaft 22 while simultaneously maintaining a protective cover of otherwise exposed portions of the shaft clearance opening 46. Upon return of the cutter 20 to a position at or above the surrounding roadway surface, the cover plates 48,50 are automatically returned to their initial overlapping position at which they overlay the shaft clearance opening 46.

Other aspects, objects and advantages of this invention can be obtained from a study of the drawings, the disclosure, and the appended claims.

We claim:

1. An end closure for a housing on a road planer enclosing a rotary cutter having a centrally disposed rotatable shaft assembly mounted on a frame, comprising:

a vertically movable end plate slidably mounted on said frame transversely with respect to said rotatable shaft assembly and forming an end of said housing and having an opening extending in a substantially vertical direction;

a pair of cover plates pivotally mounted on an external surface of said end plate; and, means for moving said cover plates between a closed position at which the cover plates cooperatively overlay said opening in said end plate and an open position at which the cover plates are spaced from said opening in said end plate in response to moving said end plate vertically with respect to said frame.

2. An end closure, as set forth in claim 1, wherein said means for moving said cover plates comprises a groove in each one of said pair of cover plates, and a pair of pins attached to said frame and extending outwardly from said frame and engaging a respective groove of each cover plate.

* * * * *